US005131549A

United States Patent [19]

Battegazzore

[11] Patent Number: 5,131,549

[45] Date of Patent: Jul. 21, 1992

[54] TAMPER-EVIDENT CLOSURE FOR SPIRITS BOTTLES AND THE LIKE

[75] Inventor: Piero Battegazzore, Alessandria, Italy

[73] Assignee: Guala S.p.A., Alessandria, Italy

[21] Appl. No.: 606,548

[22] Filed: Oct. 31, 1990

[30] Foreign Application Priority Data

Nov. 9, 1989 [IT] Italy ..... 22330 A/89

[51] Int. Cl.[5] ..... B65D 41/20

[52] U.S. Cl. ..... 215/252; 215/343; 215/356

[58] Field of Search ..... 215/251, 252, 258, 343, 215/344, 356

[56] References Cited

U.S. PATENT DOCUMENTS

| | | | |
|---|---|---|---|
| 3,850,328 | 11/1974 | Guala | 215/252 |
| 4,232.795 | 11/1980 | Vigna | 215/21 |
| 4,493.427 | 1/1985 | Wolkonskey | 215/230 |
| 4,530.437 | 7/1985 | Gray et al. | 215/252 |
| 4,679,696 | 7/1987 | Bonnenfaut et al. | 215/252 |
| 4,775,064 | 10/1988 | Baxter | 215/230 |

FOREIGN PATENT DOCUMENTS

| | | | |
|---|---|---|---|
| 2213772 | 9/1973 | Fed. Rep. of Germany | 215/252 |
| 2338069 | 2/1974 | Fed. Rep. of Germany | 215/252 |
| 2508388 | 9/1975 | Fed. Rep. of Germany | 215/252 |
| 2518117 | 11/1976 | Fed. Rep. of Germany | 215/252 |
| 2039817 | 8/1980 | United Kingdom | 215/252 |
| 2187177 | 9/1987 | United Kingdom | 215/253 |

*Primary Examiner*—Stephen Marcus
*Assistant Examiner*—Stephen Cronin
*Attorney, Agent, or Firm*—Notaro & Michalos

[57] ABSTRACT

A tamper-evident closure for a spirits bottle and the like, which can be easily and rapidly applied to the bottle during the bottling step and affords improved pouring of the bottle contents in use, comprises a cap having an inside threadway, a cylindrical sleeve coaxial with the cap, having an upper edge, an outside threadway matching the inside threadway of the cap, an inside spline formation and a lower edge, as well as a tamper-proofing seal formed between the cap and the sleeve, the sleeve being adapted to arrange itself with the upper and lower edges facing respective shoulders formed on the bottle, and with the inside spline formation engaged with a corresponding spline formation formed on the bottle.

5 Claims, 2 Drawing Sheets

TAMPER-EVIDENT CLOSURE FOR SPIRITS BOTTLES AND THE LIKE

FIELD AND BACKGROUND OF THE INVENTION

This invention relates to a tamper-evident closure, for a spirits bottle and the like.

Closures of this kind have been known and widely utilized wherein the cap stopper and tamper-proofing seal are a unitary construction provided with a weakening line to be ruptured on the bottle being opened for the first time.

While being beneficial from several aspects, such prior closures have a disadvantage which reveals itself on their application, in the form of an individually handled unit, to a bottle during the bottling process.

In fact, their application requires complex equipment which can feed the closure axially over the bottle and at the same time thread it down.

Unavoidable variations between bottles, as due to fairly wide manufacturing tolerances both in respect of diameter dimensions and ovalization errors, make the operation an inconsistent one, and result simetimes in improper fitting, e.g. due to premature, undesired rupturing of the weakening line.

SUMMARY OF THE INVENTION

The problem that underlies this invention is to provide a closure of the type specified above, which has such constructional and performance characteristics as to overcome the aforesaid disadvantage.

This problem is solved by a tamper-evident closure as set forth in the claims.

Further features and advantages of a closure according to this invention will become apparent from the following detailed description of a preferred embodiment thereof, given by way of illustration and not of limitation with reference to the accompanying drawings.

DESCRIPTION OF THE PREFERRED EMBODIMENTS

Figure 1:
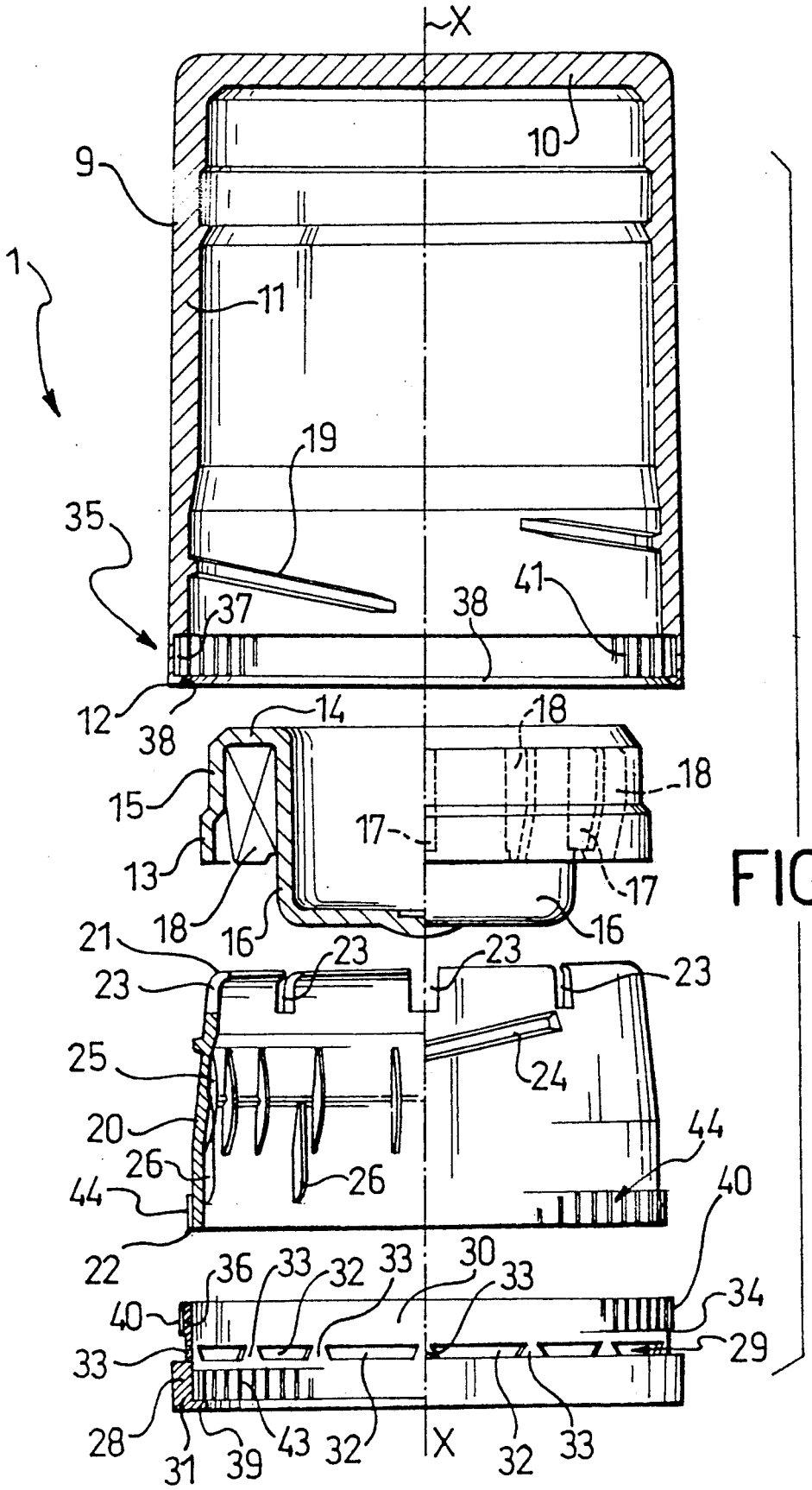
FIG. 1 is a part-sectional exploded elevation view of a closure according to the invention.

Generally shown at 1 in the drawings is a tamper-evident closure for a bottle 2, specifically a bottle containing spirits or the like.

The bottle 2 has an annular edge or rim 3 about an axis X—X, an end section 4 which is fairly long and slightly tapered and followed by a groove 5 bordered by a down-facing shoulder 6 and an up-facing shoulder 7.

The bottle 2 is formed, at the groove 5 having a height dimension which is substantially equal to the length of the section 4, with an outward splined formation 8 having axial splines.

The closure 1 comprises a cap 9 having a bottom 10 and a cylindrical skirt 11 about the axis X—X which is terminated with an edge 12.

Associated with the cap 9, on the side thereof adjacent to the bottom 10 is a sub-cap 13 having a bottom 14, a cylindrical skirt 15 about the axis X—X, and a central projection 16 sized to fit in sealed relationship inside the bottle.

The sub-cap 13 is completed by six radial ribs 17 which extend at equal distances apart between the skirt 15, the bottom 14, and the projection 16 over a predetermined axial length, and by six radial ribs 18, being equi-spaced and interleaved with the ribs 17, over a predetermined axial length which is greater than the axial length of the ribs 17 by about one millimeter. It should be noted that the ribs 18 are deformable axially along the axial direction to act as elastic means.

On the side adjacent to the edge 12, the cap 9 is formed with an inside threadway 19.

The closure 1 further comprises a substantially cylindrical sleeve 20 about the axis X—X which extends coaxially with the cap 9 and has an upper edge 21 and a lower edge 22. The sleeve 20 has a length dimension which is slightly smaller than the height of the groove 5 and is sized to fit into the groove 5 after being snapped over the section 4, thereby the edges 21 and 22 will be facing the shoulders 6 and 7, respectively.

Preferably, the upper edge 21 is slightly bent inwardly and interrupted by equi-spaced radial cuts 23.

It should be noted that the sleeve 20 is formed externally with an outside threadway 24 matching the inside threadway 19, and formed internally with an axial spline formation 25 adapted to match the outward spline formation 8.

Short stiffening ribs 26 run axially along the interior of the sleeve 20, on the side thereof next to the lower edge 22.

The closure 1 further comprises a tamper-proofing seal generally shown at 27 and described in detail in the following.

The tamper-proofing seal 27 comprises a collar 28, substantially cylindrical about the axis X—X and coaxial with the cap 9 and being short in length.

Substantially at the middle of its length, the collar 28 is formed with a weakening line 29 which extends circumferentially and defines on the collar 28 an upper band 30 and a lower band 31 which can be pulled apart.

In particular, the weakening line 29 is embodied by a plurality of equi-spaced slots 32 which define in pairs two frangible bridges 33, preferably in the shape of isosceles trapezoids with the minor base upwards.

The collar 28 is provided upwardly with snap-on means 34 of engagement adapted to engage with snap action counter-means 35 formed on the cap 9.

In particular, the snap-on means 34 of engagement are an annular border 36 protruding from the band 30, whilst the snap-action counter-means 35 of engagement are an annular recess 37 formed on the interior of the cap 9 in the vicinity of its border 12.

In order for the border 36 to engage in the recess 37, the edge 12 of the cap has an invitation bevel 38.

The collar 28 is provided downwardly with a flange 39 turned in which is intended to abut against the lower edge 22 of the sleeve 20 from underneath.

Advantageously, on the one side, an axial spline formation 40 provided on the border 36 and an axial spline formation 41 formed in the recess 37 form a spline connection 42 between the collar 28 and the cap 9, while on the other side, an axial spline formation 43 formed on the flange 39 and an axial spline formation 44 on the edge 22 form a spline connection 45 between the collar 28 and the sleeve 20.

Thanks to the aforesaid two spline connections 42 and 45, the cap 9 and the sleeve 20 are made fast rotatively together through the collar 28, at least until the two bands 30 and 31 are separated by rupturing the bridges 33.

The closure 1 is a unitary construction manipulable individually as described herein below. Firstly, the sub-cap 13 is caused to snap into the cap 9 interior.

The cap 9 thus completed is then threaded to the sleeve 20 until a short portion of the sleeve 20 is left to project out of the cap 9 whose length is approximately one half the length of the collar 28.

At this time, the collar 28 is snap fitted between the cap 9 and the sleeve 20 such that the border 36 will engage with the recess 37, the flange 39 abut against the lower edge 22 of the sleeve 20, and the spline connections 42 and 45 are established at the same time.

In this way, the closure 1 is assembled into an individually manipulable unit, with the sleeve 20 and the cap 9 made rotatively rigid together by the collar 28 provided.

To apply the closure 1 to a bottle, it will be sufficient to fit it axially over the bottle during the bottling step.

On fitting the closure on, the sleeve 20 will snap elastically past the tapering section 4 and engage in the groove 5.

The fitting action is maintained until the ribs 17 abut substantially against the edge 3 of the bottle. Under this condition, the longer ribs 18 are loaded elastically.

Figure 2:
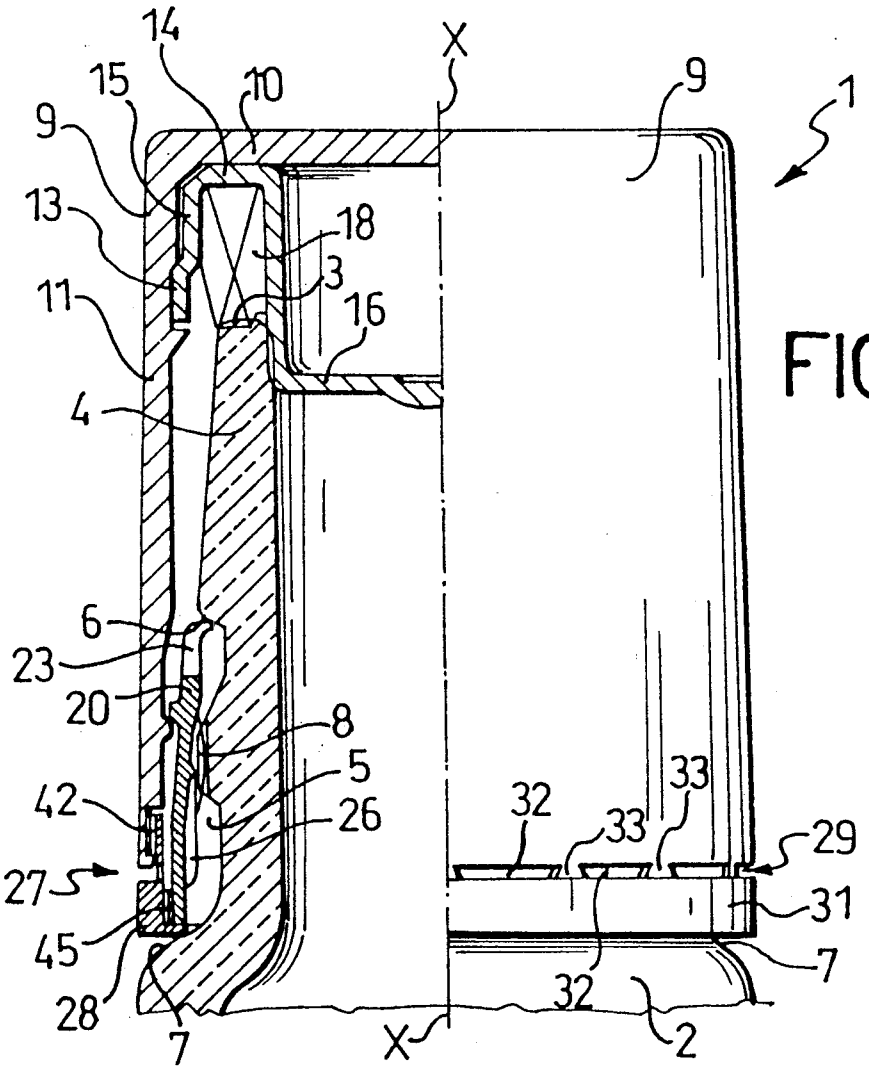
FIG. 2 is an elevation view of the closure in FIG. 1, shown at one stage of its operation.

On releasing the closure 1, the elastic recovery of the ribs 18 will cause the upper edge 21 of the sleeve 20 to abut against the shoulder 6 of the bottle (see FIG. 2).

Under this condition, the closure 1 is securely associated with the bottle from both the standpoint of its axial displacement along the direction X—X and of its rotation about the axis X—X, because of the engagement established between the spline formation 25 on the sleeve and the bottle spline formation 8.

At the same time, a limited axial clearance is formed between the collar 28 and the shoulder 7 of the bottle.

Figure 3:
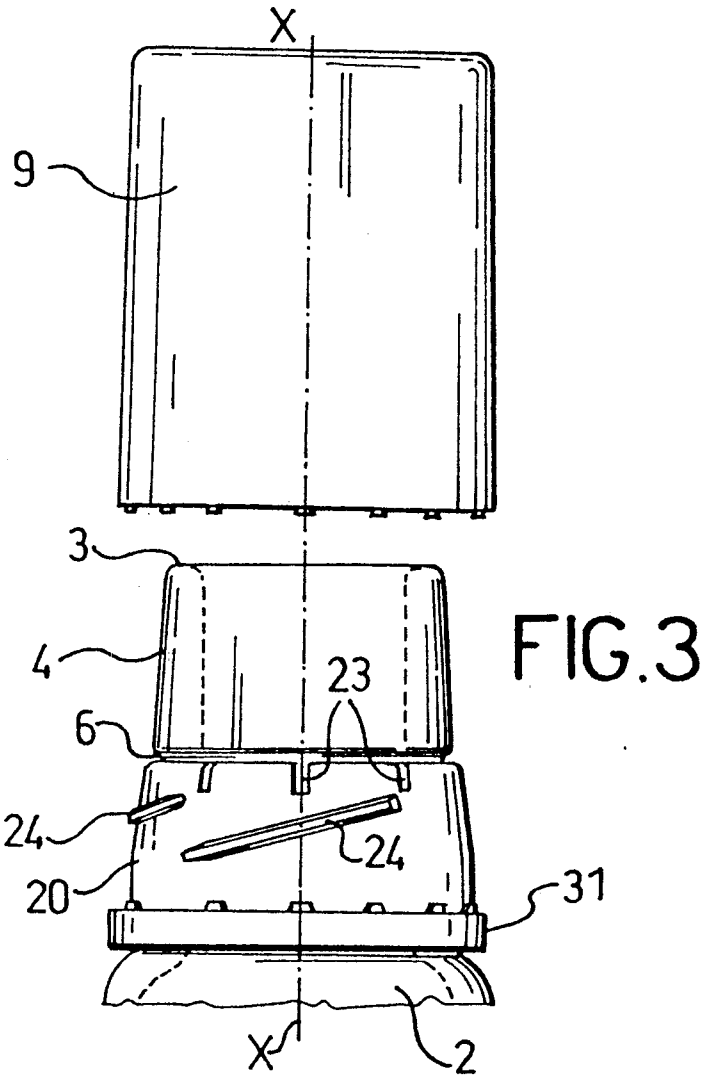
FIG. 3 is an elevation view, drawn to a reduced scale, of the closure in FIG. 1 at another stage of its operation.

To open the bottle, it will suffice that the cap 9 be screwed off. This screwing-off action causes the band 30 to rotate and be displaced axially, with immediate rupture of the bridges 33 on account both of a pull stress and a shear stress, since the band 31 will remain attached to the sleeve 20 by the flange 39 abutting the lower edge 22 of the sleeve 20 and because of the spline connection between the formation 43 and the formation 44 (see FIG. 3).

After the bottle is opened as described above, its contents can be poured out as desired. This pouring action is facilitated by the tapering section 4.

The bottle can be closed again quite easily by screwing the cap 9 back on. Under this condition, that the bottle has been opened is attested by the visible rupture of the frangible bridges, and by that the band 31 has moved down to rest onto the shoulder 7, away from the band 30 and the cap 9.

The major advantage of a closure according to the invention resides in that it has shown to be readily applicable to a bottle as an individually manipulable unit by simply fitting it axially on.

A further advantage of a closure according to the invention has shown to be the fact that it lends itself for application to a bottle which is quite simple and inexpensive.

Another advantage of a closure according to the invention is that it can be used with bottles affording improved pouring conditions because formed with no threadway close to their annular rim, but simply provided with a long tapered end section.

A not least advantage of a closure according to the invention is that it has shown to be structurally simple and suited to very large volume manufacturing.

It is understood that the above-described closure may be altered and modified in several ways by a skilled person in the art to meet specific contingent demands, without departing from the scope of the invention as defined in the appended claims.

I claim:

1. A tamper-evident closure for a bottle of spirits having a bottleneck with an end section for pouring the spirits, the end section including an annular groove formed between a down-facing shoulder and an up-facing shoulder on the end section, the groove having a selected height and containing an outward splined formation having axial splines, the closure comprising:

a substantially cylindrical sleeve positioned in the groove and having a length which is slightly shorter than the height of the groove for engagement between the down-facing and up-facing shoulders of the end section, said sleeve having an outside threadway, and an inside splined formation for engagement with the outside splined formation in the groove for non-rotatably and non-axially engaging said sleeve with the end section of the bottle;

a cap coaxial with said sleeve and including an inside threadway threadably engageable with said outside threadway of said sleeve for threadably engaging said cap to said sleeve, said cap including means for closing the end section of the bottle; and a tamper-proofing seal connected between said sleeve and said cap including frangible means which are frangible when said cap is unthreaded from said sleeve to remove said cap from the end section of the bottle.

2. A tamper-evident closure according to claim 1, wherein said tamper-proofing seal comprises a cylindrical collar coaxial with said cap and said sleeve, said collar including a lower band non-rotatably connected to said sleeve and a upper band non-rotatably connected to said cap, said frangible means including at least one weakening bridge connected between said upper and lower bands for being broken with relative rotation between said cap and said sleeve when said cap is unthreaded from said sleeve.

3. A tamper-evident closure according to claim 2, including a spline connection formed between said upper band and said cap, and a spline connection formed between said lower band and said sleeve.

4. A tamper-evident closure according to claim 3, including elastic means associated with said cap and adapted to engage the bottle to constantly bias an upper edge of said sleeve against its respective shoulder formed on the bottle.

5. A tamper-evident closure according to claim 4, wherein said elastic means are ribs formed on a sub-cap fitting coaxially within said cap.

* * * * *